US008348497B2

(12) United States Patent
Daout

(10) Patent No.: US 8,348,497 B2
(45) Date of Patent: Jan. 8, 2013

(54) FLAT BALANCE SPRING FOR HOROLOGICAL BALANCE AND BALANCE WHEEL/BALANCE SPRING ASSEMBLY

(75) Inventor: Jerome Daout, Rolle (CH)

(73) Assignee: Rolex S.A., Geneva (CH)

( * ) Notice: Subject to any disclaimer, the term of this patent is extended or adjusted under 35 U.S.C. 154(b) by 244 days.

(21) Appl. No.: 12/883,540

(22) Filed: Sep. 16, 2010

(65) Prior Publication Data

US 2011/0069591 A1 Mar. 24, 2011

(30) Foreign Application Priority Data

Sep. 21, 2009 (CH) ..... 1454/09
Mar. 9, 2010 (CH) ..... 0319/10

(51) Int. Cl.
*G04B 17/04* (2006.01)

(52) U.S. Cl. ..... 368/175

(58) Field of Classification Search ..... 368/168–178, 368/127; 267/273, 156; 968/111; 29/896.9
See application file for complete search history.

(56) References Cited

U.S. PATENT DOCUMENTS

| | | | | |
|---|---|---|---|---|
| 209,642 | A | 11/1878 | Berlitz et al. | |
| 3,528,237 | A * | 9/1970 | Suard | 368/175 |
| 3,550,928 | A | 12/1970 | Antritter et al. | |
| 3,738,101 | A | 6/1973 | Simon-Vermot | |
| 3,782,169 | A | 1/1974 | Simon-Vermot | |
| 4,595,184 | A * | 6/1986 | Bohm et al. | 267/156 |
| 7,077,562 | B2 * | 7/2006 | Bourgeois et al. | 368/175 |
| 7,344,302 | B2 | 3/2008 | Musy et al. | |
| 7,682,068 | B2 | 3/2010 | Bourgeois | |
| 7,950,847 | B2 * | 5/2011 | Zaugg et al. | 368/175 |
| 8,002,460 | B2 * | 8/2011 | Daout et al. | 368/175 |
| 8,215,828 | B2 * | 7/2012 | Zaugg et al. | 368/175 |
| 2006/0055097 | A1 | 3/2006 | Conus et al. | |
| 2006/0262652 | A1 | 11/2006 | Musy et al. | |
| 2008/0008050 | A1 | 1/2008 | Bourgeois | |

FOREIGN PATENT DOCUMENTS

| | | |
|---|---|---|
| BE | 526689 A | 3/1954 |
| CH | 327796 A | 2/1958 |
| CH | 1060869 D | 6/1971 |
| EP | 1431844 A1 | 6/2004 |
| EP | 1445670 A1 | 8/2004 |

(Continued)

OTHER PUBLICATIONS

Dr. Ludwig Oechslin, "Silicon and Watchmaking, Report of Trials with silicon hairsprings at the Musee International d'Horologie," ThePuristS.com, La Chaux-de-Fonds, Switzerland, Jan. 2006, cited in Swiss SR No. CH00319/10.

(Continued)

*Primary Examiner* — Edwin A. Leon
(74) *Attorney, Agent, or Firm* — Westerman, Hattori, Daniels & Adrian, LLP

(57) ABSTRACT

This flat balance spring for a horological balance comprises a wound strip shaped to ensure an approximately concentric development of the balance spring and almost zero force on the pivots and on the fixing point, during a rotation of less than 360° of its inner end relative to its outer end in both directions from its rest position. The stiffness of its strip decreases gradually and through more than 360° from each of its two ends, the lowest stiffness being situated in the median part of the strip.

20 Claims, 5 Drawing Sheets

FOREIGN PATENT DOCUMENTS

| | | | |
|---|---|---|---|
| EP | 1473604 | A1 | 11/2004 |
| EP | 1605182 | A1 | 12/2005 |
| WO | 2004/070476 | A1 | 8/2004 |

OTHER PUBLICATIONS

"Silicum (suite) La lubrification moins contraignante," Forumamontres, Aug. 2006, cited in Swiss SR No. CH00319/10.

Michel, Emile & Michel, Gaston "Spiraux Plats Concentriques Sans Courbes," Bulletin Annuel de la Societe Suisse de Chronometrie et du Laboratoire de Recherches Horlogeres, Jan. 1963, vol. 4, pp. 162-169, cited in spec. and in Swiss SR No. CH01454/09.

Musee International d'Horlogerie, "Tests with Silicon Hairsprings: Report of Trials with silicon hairsprings at the Musee International d'Horologie (2)," ThePuristS.com, La Chaux-de-Fonds. Switzerland (Jan. 2006).

Swiss Search Report of CH00319/10, mailing date Jun. 4, 2010.

Swiss Search Report of CH01454/09, mailing date Dec. 15, 2009.

* cited by examiner

FLAT BALANCE SPRING FOR HOROLOGICAL BALANCE AND BALANCE WHEEL/BALANCE SPRING ASSEMBLY

BACKGROUND ART

This invention relates to a flat balance spring for a horological balance comprising a wound strip shaped to ensure an approximately concentric development of the balance spring and almost zero force on the pivots and on the fixing point, during the rotation of less than 360° of its inner end relative to its outer end in both directions from its rest position. This invention also relates to a balance wheel/balance spring assembly.

The non-concentric development of a balance spring fitted to a horological balance during the oscillation of the balance wheel/balance spring assembly results in an eccentricity of the center of gravity of the balance spring which, depending on the position occupied by the watch, causes the movement to run slow or fast, that is to say it reduces or increases the natural frequency of the balance wheel/balance spring system. This eccentricity of the center of gravity of the balance spring also causes the pivots of the balance to exert sideways pressure on the bearings.

These effects of imbalance of the balance spring and sideways pressures of the pivots destroy the necessary conditions of isochronism of the oscillations of the balance. Since the middle of the 18th century, watchmakers have been aware that the non-concentric development of the balance spring has a bad influence on isochronism and in particular that the sideways pressure caused by an eccentric balance spring on the balance pivots disturbs the rate and causes pivot wear. These same watchmakers therefore recommended forming one or two end curves, initially on cylindrical balance springs and, later, on an Archimedean type balance spring contained in a plane, which is known as the Breguet balance spring from the name of its inventor.

These curves were produced more or less empirically and corrected according to the results of the rate of the oscillator, until certain shapes rose to preference in the light of these results. It was several decades before the mathematics behind this end curve were studied by Edouard Phillips, thus supplying theoretical confirmation of the previous intuitions of watchmakers, namely that if the center of gravity of the balance spring is kept approximately on the balance staff as the balance wheel/balance spring system oscillates, the balance spring will exert relatively no sideways force on the pivots of the balance and its development will remain concentric.

The conditions described by Phillips are the same as those defined by the watchmakers who had deduced them themselves from their observations of the faults introduced by the balance spring, as compared with the rules governing the isochronism of an oscillating body described in the 17th century by Huygens.

The Breguet balance spring requires that an end curve be formed in a plane parallel to the plane of the flat balance spring. This requires the formation of two bends in opposite directions to form an inclined connecting segment between the balance spring and the parallel end curve.

A Breguet balance spring can be manufactured in various ferromagnetic or paramagnetic alloys, notably for self-compensating balance springs. However, it is much more difficult to manufacture it in a fragile material such as monocrystalline or polycrystalline silicon because the two reversed bends designed to allow formation of the Breguet end curve cannot be formed because a fragile material of this kind would break, and it is therefore necessary to resort to a technique enabling the formation of structures that are connected across a plurality of levels.

It has already been proposed that a technical effect comparable to that of the Breguet curve can be obtained on a flat balance spring by varying the thickness of the strip of the balance spring.

In U.S. Pat. No. 209,642 it is proposed that the thickness of the strip of the balance spring be increased gradually or discontinuously from the center to the outside of the balance spring.

CH 327 796 proposes modifying the cross section of the strip of the balance spring to make it stiffer, along an arc of not more than 180°, either in the center or on the outside. This modification is accomplished by bending, by addition of material (as by galvanic deposition or welding), or by thickness reduction (as by calendering or chemical etching).

U.S. Pat. No. 3,550,928 recommends stiffening the end curve of the balance spring with a non-rectangular cross section obtained by plastic deformation of part of the last turn.

EP 1 473 604 relates to a flat balance spring comprising on its outer turn a stiffened portion designed to make the deformations of the turns approximately concentric.

BE 526689 proposes varying a cross section of the strip of the balance spring along one or more parts of its length, or modifying the profile or adding to one or more parts of the strip a body (any body) designed to modify the flexibility of these parts. No further details are given as to these variations or modifications.

Emile and Gaston Michel, in their article *Spiraux plats concentriques sans courbes* [Concentric Flat Balance springs Without Curves], Bulletin Annuel de la Société Suisse de Chronométrie et du Laboratoire de Recherches Horologères, Vol. IV, 1957-1963, pages 162-169, Jan. 1, 1963, suggest giving part of the strip a v-shaped cross section. "This v-shaped part exhibits practically no deformation at high amplitudes. It now contributes nothing to the regulation and is as it were a dead part of the turn" (bottom of page 164 to top of page 165). This in effect neutralizes the balance spring for part of its length.

EP 1431844 relates to a balance spring whose cross section varies from one of its ends to the other. However, few details are given as to the form of variation of the cross section of the balance spring. The only information is that given in FIG. 11 and in the corresponding part of the description. The definition given on page 4, lines 55-57 speaks of "variable parallelepiped-shaped cross section", "in this instance a rectangular cross section E toward the center which changes to become a square cross section E' on the outside". This definition, the only information given as to the type of variation, calls to mind a monotonic variation, because the two cross sections E-E' between which the cross section varies appear to imply a continuous and monotonic variation of the cross section.

The question of the variation of the pitch illustrated in FIG. 10 of EP 1431844 is limited to a variation of the pitch along a radial axis F-F' which gives to the balance spring an elliptical form. What this figure shows resembles rather a deformation of the balance spring spiral along one of the two axes than a variation of the pitch strictly speaking, and does not result in a functional balance spring, especially a balance spring whose turns do not touch each other in operation.

Lastly, in EP 1 593 004, the cross section of the strip of the balance spring decreases gradually from the center of the balance spring toward the outside.

SUMMARY OF THE INVENTION

All the balance springs mentioned above are designed to improve the isochronism of the balance wheel/balance spring oscillator in the varying positions of the watch. A study by simulation of these different balance springs shows however that it is difficult to get much below a maximum error between the different positions of 4 seconds per day at typical operating amplitudes, which means amplitudes of greater than 200°, without jeopardizing the safety margins for ensuring that turns do not touch each other in operation during the contraction and expansion of the balance spring, or if the wristwatch is struck. Moreover, the average slope of the rate curves plotted against the amplitude of the balance wheel/balance spring oscillator should be as low as possible, ideally slightly negative so as to compensate for errors of isochronism introduced by an inline lever escapement. It would also be more difficult to achieve good performance with small balance springs, for example measuring less than 2.5 mm distance between the axis of rotation and the outer end.

The object of the present invention is to provide a solution that gets closer to these objectives than prior art balance springs.

For this purpose the primary subject of this invention is a flat balance spring for a horological balance comprising a wound strip shaped to ensure an approximately concentric development of the balance spring and almost zero force on the pivots and on the fixing point, during the rotation of less than 360° of its inner end relative to its outer end in both directions from its rest position, said balance spring being characterized in that the stiffness of its strip decreases gradually and through more than 360° from, on the one hand a point situated between its inner end and its second turn, and on the other hand a point situated between its outer end and its penultimate turn, the lowest stiffness being situated in the median part of said strip. A further subject of the invention is a balance wheel/balance spring assembly using such a balance spring.

The expressions "approximately concentric development" and "almost zero force" are intended to cover balance springs capable of performing at least as well as Breguet curve balance springs, its object being to perform at least as well as the latter, but with a flat balance spring.

The balance spring according to the invention applies to balance springs made of a ductile material as well as to fragile materials such as silicon.

BRIEF DESCRIPTION OF THE DRAWINGS

The accompanying drawings illustrate, diagrammatically and by way of example, various embodiments of the flat balance spring of the present invention.

DETAILED DESCRIPTION OF PARTICULAR EMBODIMENTS

Figure 1:
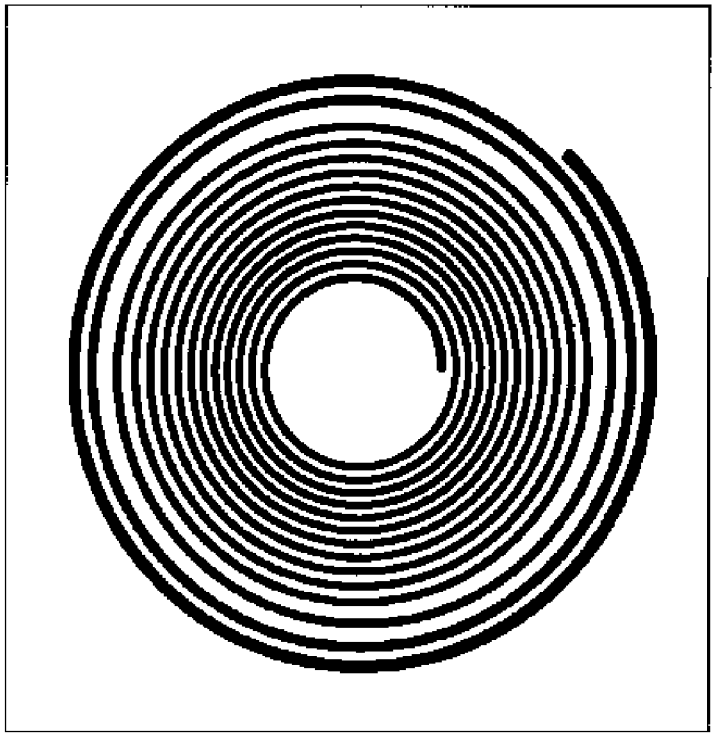
FIG. 1 is a plan view of a flat balance spring at rest with its center of gravity situated on the intended center of rotation of this balance spring.

The performance of the balance wheel/balance spring oscillator, especially the rate error between the positions, can vary substantially with the torque developed by the balance spring and with its size, meaning the distance between the inner point of attachment of the balance spring to the collet and the outer point of attachment. The number of revolutions also has a significant influence. For this reason, the balance springs given by way of example in the figures all have the same nominal torque (same inertia of the balance coupled to the balance spring to obtain an oscillation frequency of 4 Hz), and the same size. The balance springs are manufactured in Si. The distance to the axis of rotation is 0.6 mm for the inner end and 2.1 mm for the outer end. The height of the turns is 150 μm.

To selectively increase or decrease the stiffness of the strip of the balance spring, its cross section can be modified, more specifically the thickness of the strip because it is known that the stiffness of the strip varies with the cube of the thickness. Another possibility would be to apply a localized heat treatment, or to modify the shape of the strip for example without changing the cross section, e.g. by modifying the orientation of the cross section of the balance spring about the intended center of rotation of this balance spring. This could be done by twisting it or forming undulations in the strip of the balance spring, or combining these stiffening methods with the change of cross section.

The balance spring of the invention may be made of a fragile material, notably a crystalline material such as silicon. It is easy to make such a balance spring with a variable cross section by the manufacturing method described in EP 0732635 B1, which uses the techniques of masking with chemical etching, techniques that have reached an advanced stage of perfection in the electronics field for working silicon wafers in particular. The document itself describes a manufacturing method that can be used for balance springs or the like. Although the document does not mention the possibility of making a balance spring of non-constant section, it is obvious that the masking technique it uses is ideally suited to obtaining such a result. Moreover, the method it describes makes it possible to produce the balance spring, its collet and its fixing means all in one piece.

Other techniques using multilayer electroplating combined with the masking technique to produce micromechanical parts are described in two articles published in Elsevier Sensors and Actuators A 64 (1998) 33-39, High-aspect-ratio, ultrathick, negative-tone near-UV photoresist and its applications for MEMS, and in Elsevier Sensors and Actuators A 53 (1996) 364-368, Low-cost technology for multilayer electroplated parts using laminated dry film resist. These techniques can therefore be used to form micromechanical metal parts with a high aspect ratio and are therefore ideally suited to the manufacture of a metal balance spring of variable cross section for producing a balance spring with non-monotonic variation of stiffness. Using these techniques it is therefore also possible to make a metal balance spring.

The methods mentioned are of course very suitable for producing balance springs in which the cross section of the strip is not constant in order to produce a stiffness that varies non-monotonically as a means of keeping the center of gravity of the balance spring approximately on this balance spring's intended center of rotation. One could also use other methods, such as heat treatment or laser machining, to modify, at a stage subsequent to its manufacture proper, the stiffness of the balance spring in a non-monotonic way in order to obtain the desired result. Treatment or machining could also be associated with a balance spring comprising at least two segments with different cross sections.

Other ways of selectively stiffening the balance spring to achieve the desired result may be envisioned. As an example, the stiffness of the balance spring could be varied non-monotonically by forming a layer of a stiffer material. This layer could be made by electroplating, for example.

The stiffness of the balance spring could also be changed by doping the silicon using e.g. an ion implantation technique or diffusion.

Known means are used to temperature-compensate the balance springs. For instance, a layer of material on the surface of the turns can be used to compensate for the first temperature coefficient of the Young's modulus of the base material. In the case of a silicon balance spring, a suitable material for this layer is $SiO_2$.

Figure 2:
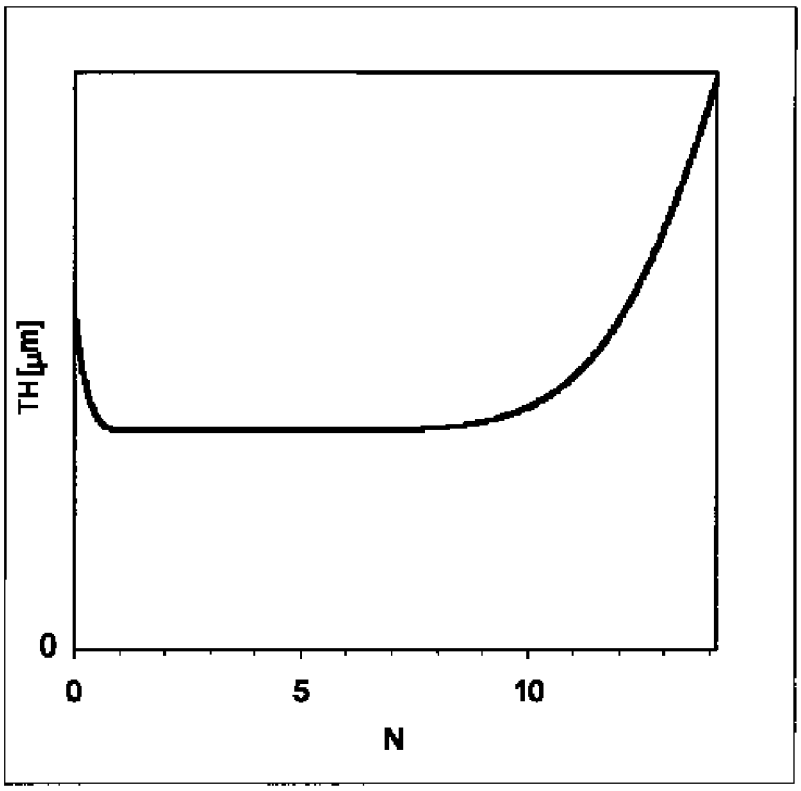
FIG. 2 is a diagram of the thickness TH of the strip of the balance spring plotted against the number of revolutions N of the balance spring seen in FIG. 1.

The balance spring of the invention illustrated in FIG. 1 has a thickened region that decreases beginning at its inner end through more than 360° and a thickened region that increases gradually through more than 360° (more than five revolutions in the case of FIG. 1) before the outer end and all the way to this outer end. This non-monotonic thickness variation is illustrated in the diagram, FIG. 2. Between the outer end of the balance spring and its minimum thickness, the thickness reduces by a factor of 2.6. Between its inner end and its minimum thickness the thickness reduces by 35%.

Figure 3:
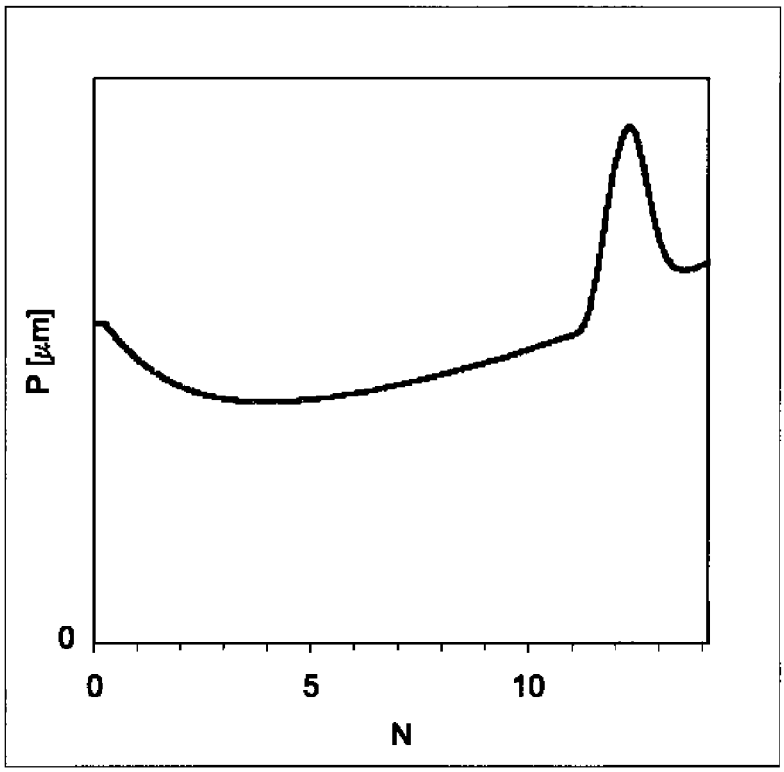
FIG. 3 is a diagram of the pitch P of the balance spring plotted against the number of revolutions N of the balance spring seen in FIG. 1.

Alongside this non-monotonic variation of thickness of the strip of the balance spring and hence of its stiffness, the pitch of the balance spring of the invention may also advantageously vary non-monotonically, as illustrated in the diagram, FIG. 3. This diagram shows a decrease in the pitch beginning at the inner end of the balance spring, followed by a slight increase, followed by a local maximum, two revolutions short of the outer end in this example. This local maximum (a sudden increase followed by a sudden decrease) is designed to prevent the turns from touching each other as the balance wheel/balance spring assembly oscillates. It will be noticed that this pitch variation does not require a significant increase in the separation of the final turn, and so a balance spring with a high number of revolutions, in this example more than 14 revolutions for a balance spring with a radius of 2.1 mm, is possible. It is known that the higher the number of revolutions, the shallower the average slope of the isochronism.

It can be seen that in this embodiment the maximum pitch of the balance spring is not situated at its outer end but is situated on the outer third of the balance spring (between 1 and 3 revolutions short of this end, more precisely at 1.75 revolutions in this example) and that the pitch has a local maximum on the outer third of the balance spring (between 1 and 3 revolutions from the outer end).

Figure 4:
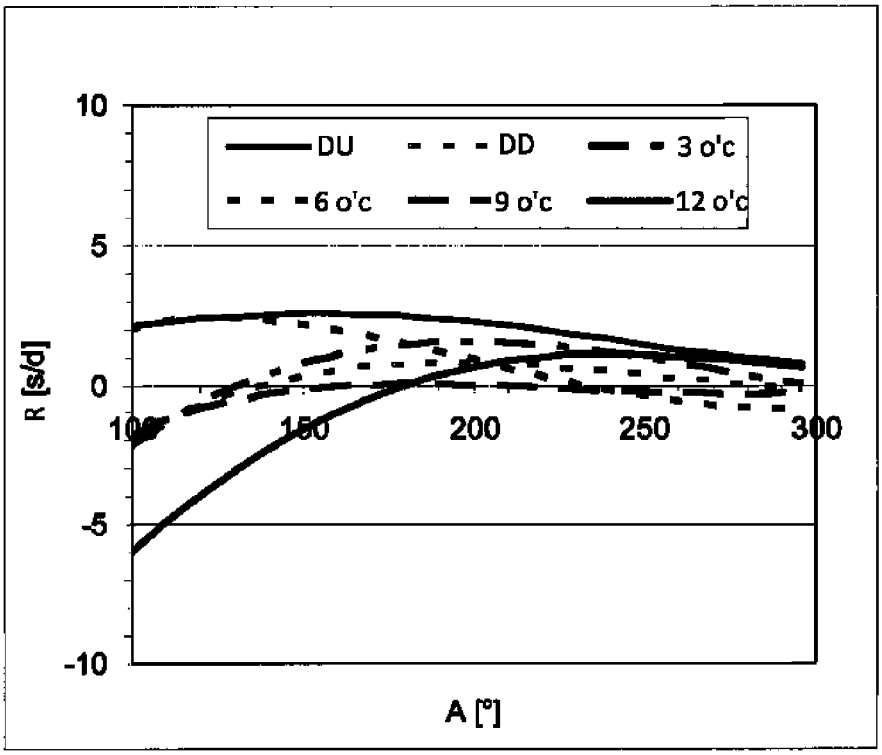
FIG. 4 is a diagram of the theoretical rate curves of a balance wheel/balance spring oscillator fitted with the balance spring seen in FIG. 1, in the various positions, plotted against the amplitude of this oscillator (free isochronism)

Simulations performed on this balance spring have shown that this balance spring geometry makes it possible to halve the maximum error between the different positions in which the timepiece is tested (DU and DD, which are the horizontal positions, Dial Up and Dial Down, respectively; 3 o' clock, 6 o' clock, 9 o' clock and 12 o' clock, which are the vertical positions rotated 90° each time between the successive positions) compared with a balance spring with constant pitch and constant thickness. The error at 250° amplitude of the balance wheel/balance spring oscillator is 1.87 seconds per day. As regards the average slope of the isochronism, the diagram, FIG. 4, shows that this is very slightly negative at this amplitude and compensates for the very slightly positive slope due to the standard inline lever escapement.

Figure 5:
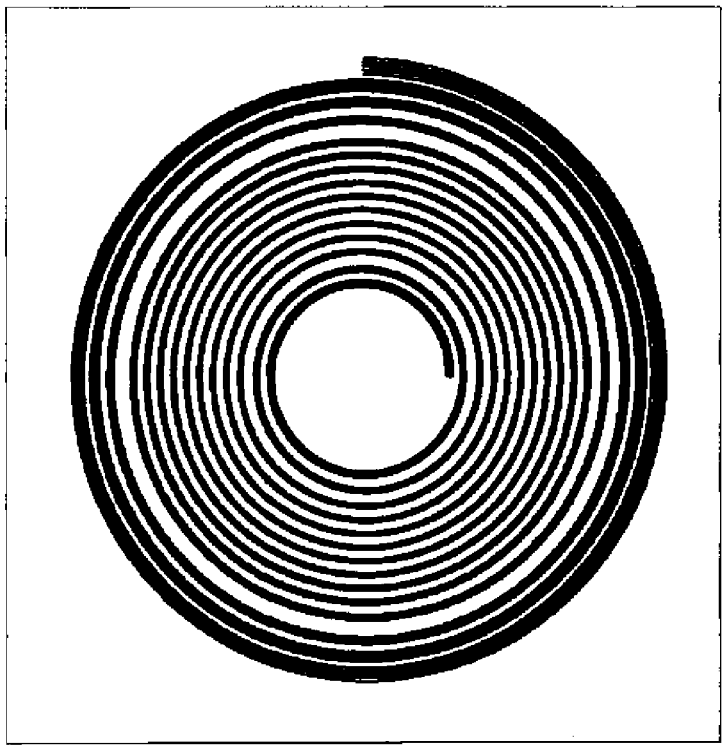
FIG. 5 is a plan view of a second embodiment of the flat balance spring at rest, its center of gravity situated on the intended center of rotation of this balance spring.

The second embodiment illustrated in FIG. 5 has two end curves of progressive stiffness, one on the inside and the other on the outside, whose job is to provide a smooth transition between the ends and the central turns. The regions where the pitch is greater are useful to prevent the turns touching each other during operation, that is during contraction and expansion. The intermediate part between these two regions can do very well with a small, approximately constant pitch (roughly 4% pitch variation in the example seen in FIG. 7). In fact, what happens during the development of the balance spring is that the intermediate part shifts globally as a whole toward the center during contraction, and outward during expansion. It therefore needs space each way. The space toward the center can be less than that around the outside, and is not therefore necessarily required as the diagram, FIG. 3, shows.

Figure 6:
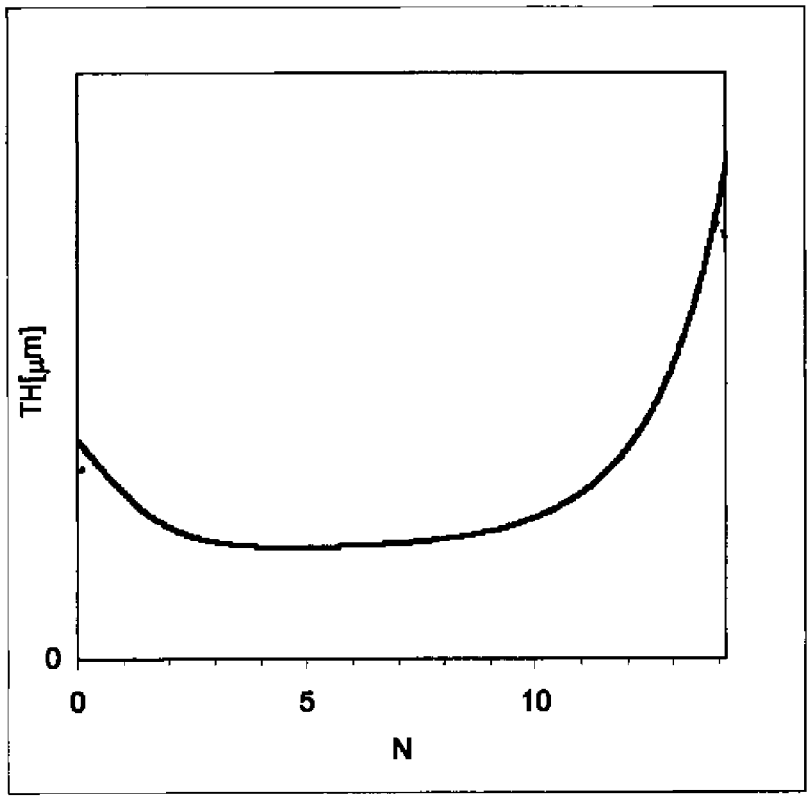
FIG. 6 is a diagram of the thickness TH of the strip of the balance spring plotted against the number of revolutions N of the balance spring seen in FIG. 5.

To summarize, the thickness diagram in FIG. 6 is similar to that of the embodiment seen in FIGS. 1-4; that is, thickened regions at both ends of the balance spring, thus forming end curves occupying more than 360°. Between the outer end of the balance spring and its minimum thickness, the thickness decreases by a factor of 4.4. Between its inner end and its minimum thickness, the thickness decreases by 48%.

In a variant of FIG. 6, the thickness of the inner and/or outer turn(s) could stop increasing, or even slightly decrease, in the last inner and/or outer revolution, without significantly changing the properties of the oscillator.

Figure 7:
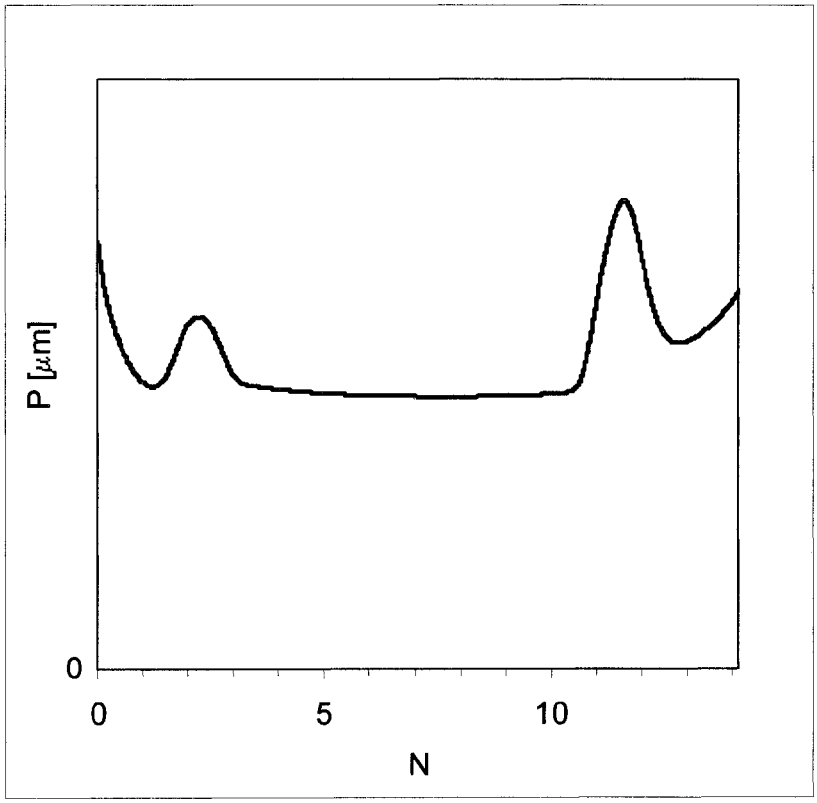
FIG. 7 is a diagram of the pitch of the balance spring P plotted against the number of revolutions N of the balance spring seen in FIG. 5.

The pitch diagram, FIG. 7, comprises non-monotonic and gradual variations, with a local maximum in the first third of the balance spring (2 revolutions away from the inner end) in addition to that in the outer third (roughly 3 revolutions short of the outer end).

Figure 8:
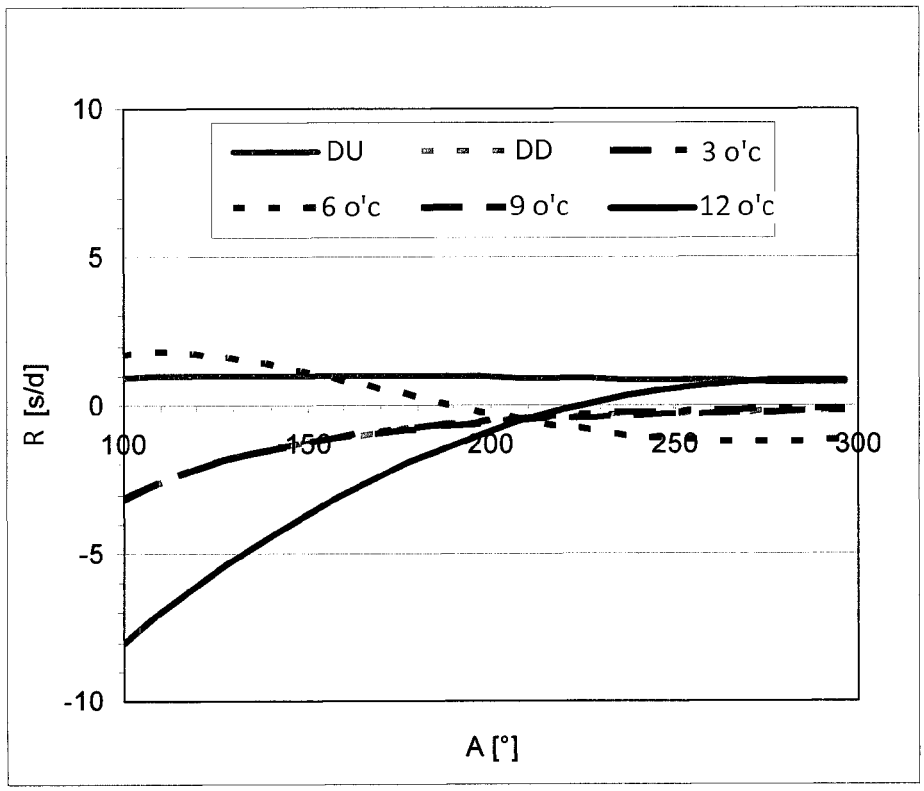
FIG. 8 is a diagram showing the theoretical rate curves of a balance oscillator fitted with the balance spring seen in FIG. 5, in the various positions, plotted against the amplitude of this oscillator (free isochronism)

As FIG. 8 shows, the error at 250° amplitude of the balance wheel/balance spring oscillator is 1.99 seconds per day and is comparable to the example seen in FIG. 4, with a smaller average error between 200° and 300° amplitude than for the balance spring seen in FIG. 1.

Figure 9:
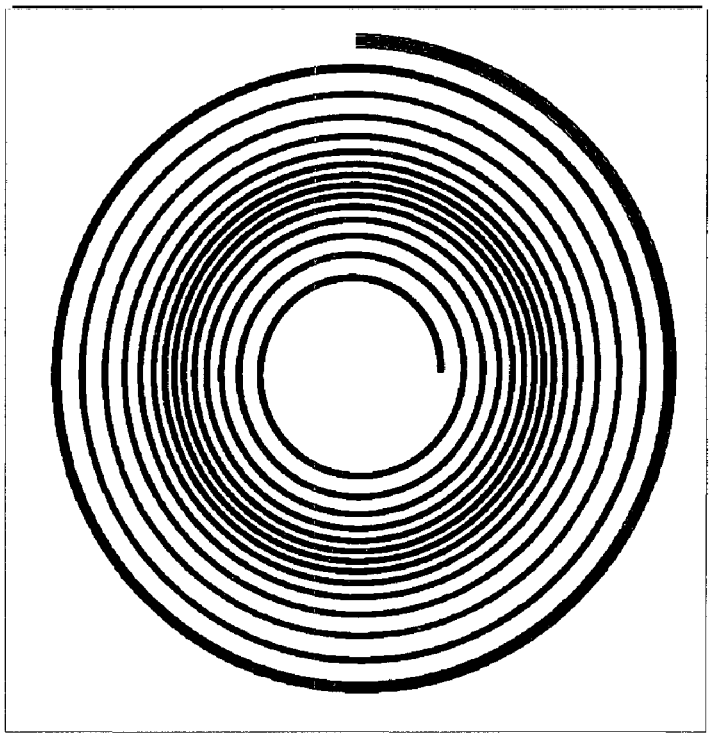
FIG. 9 is a plan view of a third embodiment of the flat balance spring at rest, its center of gravity situated on the intended center of rotation of this balance spring.

Two other embodiments are also shown. One is illustrated in FIG. 9 with regions where the turns are more separated in the inner third and in the outer third, with a smooth pitch variation, with no local maximum of the pitch either on the inside or on the outside. The curve of the thickness variation is similar to that of the first embodiment illustrated in FIG. 2, decreasing from the inner end for the first or inner third (the first four revolutions), a part where the thickness is constant, and then an increase on the outer third all the way to the outer end (the last two revolutions). The pitch itself varies non-monotonically, decreasing gradually from the inner end to the middle of the length of the balance spring and then increasing gradually as far as the outer end of the balance spring, with no local maximum. The chronometric performance is better than that of balance springs with constant pitch and constant thickness, but slightly poorer than in the first two embodiments (maximum error between positions of 2.67 seconds per day at 250°).

Figure 10:
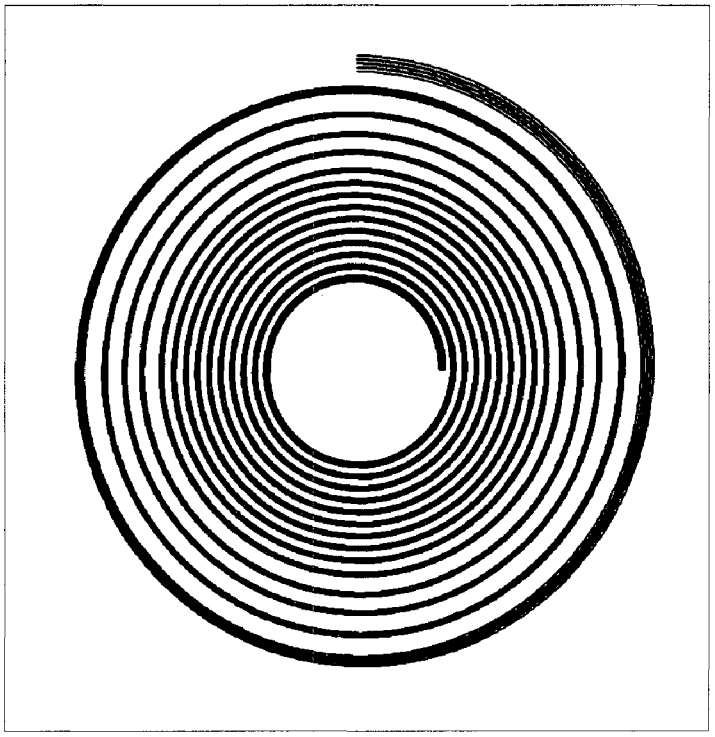
FIG. 10 is a plan view of a fourth embodiment of the flat balance spring at rest, its center of gravity situated on the intended center of rotation of this balance spring.

The other embodiment is shown in FIG. 10 and comprises a much more extensive central region with no pitch variation in the inner part of the balance spring. The curve of thickness variation is similar to that of the first embodiment illustrated in FIG. 2, decreasing from the inner end for the first third (the first four revolutions), then a part where the thickness is constant, and then an increase through the outer third all the way to the outer end (the last three revolutions). The pitch of the balance spring illustrated in FIG. 10 is constant through the first or inner third of the length of the balance spring; then has a sudden increase followed by a decrease, i.e. a local maximum, three and a half revolutions short of the outer end. The pitch then increases again all the way to the outer end. The chronometric performance is comparable to that of the first two embodiments (maximum error between positions of 2.08 seconds per day at 250°).

The above embodiments are given by way of non-restrictive examples. Furthermore, the variations of thickness and pitch must be optimized to meet the specifications of the balance spring, i.e. the developed torque and the outside size (radius at the collet and radius at the stud) in order to obtain optimum chronometric performance (the smallest possible rate errors between positions and average isochronism slope) while avoiding contact between the turns during operation.

The invention claimed is:

1. A flat balance spring for a horological balance comprising a wound strip shaped to ensure an approximately concentric development of the balance spring and almost zero force on pivots and on a fixing point of the balance spring, during a rotation of less than 360° of an inner end relative to an outer end of the balance spring in both directions from a rest position, said balance spring being characterized in that a stiffness of the strip decreases gradually and through more than 360° from (i) a point situated between the inner end and a second turn, and (ii) a point situated between the outer end and a penultimate turn, the lowest stiffness being situated in a median part of said strip.

2. The balance spring as claimed in claim 1, in which the stiffness of the strip decreases gradually and through more than 360° from each of the inner and outer ends.

3. The balance spring as claimed in claim 1, in which the pitch of the balance spring varies non-monotonically, decreasing between the outer end and the outer third, counted in terms of the number of turns.

4. The balance spring as claimed in claim 1, in which the pitch of the balance spring varies non-monotonically, decreasing between the inner end and the inner third, counted in terms of the number of turns.

5. The balance spring as claimed in claim 1, in which the pitch of the balance spring undergoes a sudden increase followed by a sudden decrease, the whole occupying more than 360° and being situated at least one turn away from at least one of the inner and outer ends.

6. The balance spring as claimed in claim 1, in which the different respective stiffnesses correspond to different respective cross sections of the strip of the balance spring.

7. The balance spring as claimed in claim 1, in which the stiffness decreases by at least a factor of 8 between a point situated between the outer end and the penultimate turn, and the minimum value.

8. The balance spring as claimed in claim 1, in which the stiffness decreases by at least 50% between the inner end and the minimum value.

9. The balance spring as claimed in claim 1, manufactured in a fragile material.

10. The balance spring as claimed in claim 1, manufactured in a crystalline material.

11. The balance spring as claimed in claim 1, manufactured in silicon.

12. A balance wheel/balance spring assembly using a balance spring as claimed in claim 1.

13. The balance spring as claimed in claim 2, in which the pitch of the balance spring varies non-monotonically, decreasing between the outer end and the outer third, counted in terms of the number of turns.

14. The balance spring as claimed in claim 2, in which the pitch of the balance spring varies non-monotonically, decreasing between the inner end and the inner third, counted in terms of the number of turns.

15. The balance spring as claimed in claim 3, in which the pitch of the balance spring varies non-monotonically, decreasing between the inner end and the inner third, counted in terms of the number of turns.

16. The balance spring as claimed in claim 13, in which the pitch of the balance spring varies non-monotonically, decreasing between the inner end and the inner third, counted in terms of the number of turns.

17. The balance spring as claimed in claim 2, in which the pitch of the balance spring undergoes a sudden increase followed by a sudden decrease, the whole occupying more than 360° and being situated at least one turn away from at least one of the inner and outer ends.

18. The balance spring as claimed in claim 3, in which the pitch of the balance spring undergoes a sudden increase followed by a sudden decrease, the whole occupying more than 360° and being situated at least one turn away from at least one of the inner and outer ends.

19. The balance spring as claimed in claim 4, in which the pitch of the balance spring undergoes a sudden increase followed by a sudden decrease, the whole occupying more than 360° and being situated at least one turn away from at least one of the inner and outer ends.

20. The balance spring as claimed in claim 13, in which the pitch of the balance spring undergoes a sudden increase followed by a sudden decrease, the whole occupying more than 360° and being situated at least one turn away from at least one of the inner and outer ends.

* * * * *